US007473135B1

(12) United States Patent
Guo et al.

(10) Patent No.: US 7,473,135 B1
(45) Date of Patent: Jan. 6, 2009

(54) HIGH-DENSITY CONNECTOR WITH EMI SHIELDING

(75) Inventors: Xiaosong Guo, Shenzhen (CN); Michael Ip, Shenzhen (CN); Ran Xiao, Shenzhen (CN)

(73) Assignee: Amphenol East Asia Electronic Technology (Shenzhen) Ltd., Guangdong Province (CN)

( * ) Notice: Subject to any disclaimer, the term of this patent is extended or adjusted under 35 U.S.C. 154(b) by 0 days.

(21) Appl. No.: 11/942,717

(22) Filed: Nov. 20, 2007

(51) Int. Cl.
*H01R 13/648* (2006.01)

(52) U.S. Cl. ..... 439/607; 439/79

(58) Field of Classification Search ..... 439/608, 439/607, 610, 79
See application file for complete search history.

(56) References Cited

U.S. PATENT DOCUMENTS 5,171,161 A * 12/1992 Kachlic ..... 439/352

* cited by examiner

*Primary Examiner*—Javaid Nasri
(74) *Attorney, Agent, or Firm*—Leong C. Lei

(57) ABSTRACT

The plug of the connector mainly contains a plug assembly formed by joining two plug pieces, each providing a number of terminals arranged along two major sides of a blade. A conducting plate is sandwiched between the two plug pieces and contacts a metallic casing housing said plug assembly. The casing also contacts an EMI shielding wall enclosing the blades of terminals. The socket of the connector mainly contains a socket assembly formed by interleaving a number of insulating pieces and shielding pieces. Each insulating piece houses four L-shaped terminals and has L-shaped shielding plates positioned in the areas between the L-shaped terminals. The shielding plates contact a metallic plate embedded inside the insulating piece and/or the adjacent shielding piece and the metallic plates in turn contact a metallic casing housing the socket assembly. The casing also contacts an EMI shielding wall enclosing the slots of terminals.

9 Claims, 10 Drawing Sheets

HIGH-DENSITY CONNECTOR WITH EMI SHIELDING

TECHNICAL FIELD OF THE INVENTION

The present invention generally relates to connectors, and more particularly to a high-density connector having superior EMI shielding for computing and communication devices.

DESCRIPTION OF THE PRIOR ART

Existing connectors for computing and communication devices usually contains a male plug and a female socket. The socket has an elongated slot with terminals (i.e., flexible metallic plates) embedded along two major inner walls of the slot. On the other hand, the plug has an elongated blade with terminals (i.e., flexible metallic plates) positioned along two major sides of the blade. When the plug is plugged into the socket, the blade of the plug is embedded into the slot of the socket and their respective terminals, due to their flexibility, touch each other to establish appropriate electric contact. The flexibility of the terminals also contributes to the tight coupling between the plug and the socket. To achieve EMI (electromagnetic interference) shielding, there are some EMI shielding elements around the plug and the socket. As the number of terminals and the speed of computing and communication are continuously increased, the limited pin count and the limited provision of the EMI shielding elements in the conventional connector's plug and socket cannot provide the required capacity and EMI shielding effect.

SUMMARY OF THE INVENTION

Accordingly, a novel high-density connector is provided herein. The plug of the connector mainly contains a plug assembly formed by joining two plug pieces, each providing a number of terminals arranged along two major sides of a blade. A conducting plate is sandwiched between the two plug pieces and contacts a metallic casing housing said plug assembly. The casing also contacts an EMI shielding wall enclosing the blades of terminals.

The socket of the connector mainly contains a socket assembly formed by interleaving a number of insulating pieces and shielding pieces. Each insulating piece has a front end with two troughs and the troughs of the insulating pieces jointly form two slots for receiving the two blades of the plug. Each insulating piece houses four L-shaped terminals of four different dimensions so that front ends of the L-shaped terminals are exposed along the four major sides of the two slots, respectively. Each insulating piece has L-shaped shielding plates positioned in the areas between the L-shaped terminals. The shielding plates contact a metallic plate embedded inside the insulating piece and/or the shielding piece and the metallic plates in turn contact a metallic casing housing the socket assembly. The casing also contacts an EMI shielding wall enclosing the slots of terminals.

When the plug is plugged into the socket, the contact of their respective EMI shielding walls makes their respective shielding mechanisms together, so as to provide superior EMI shielding effect.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
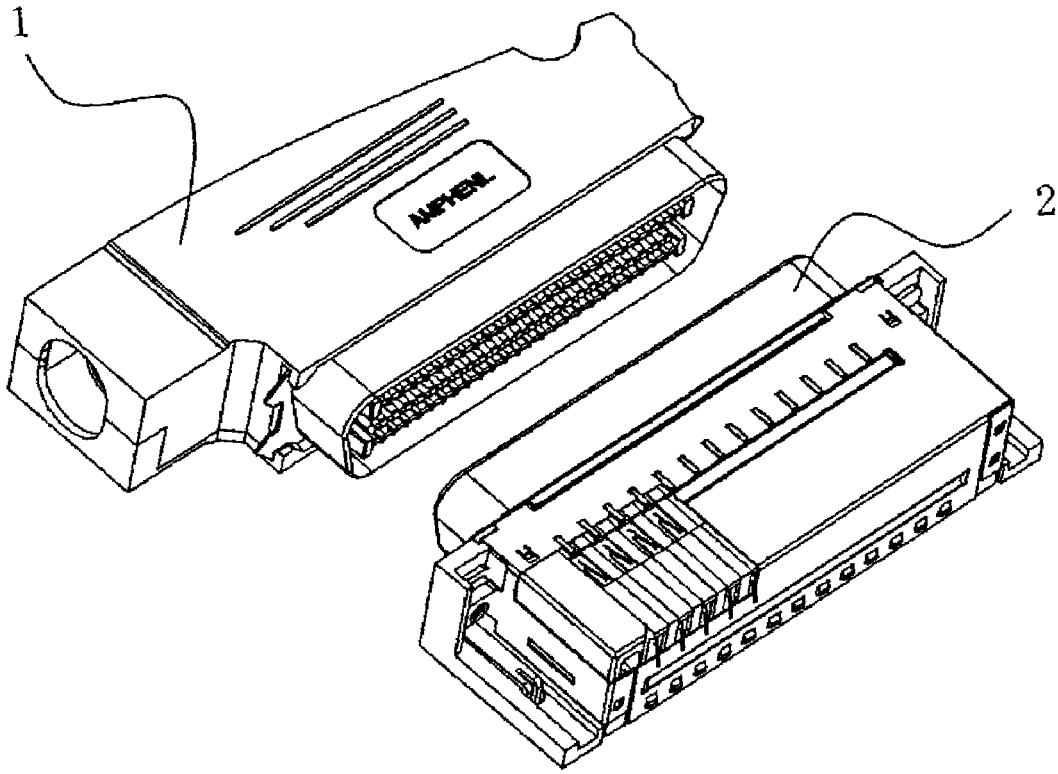
FIG. 1 is a perspective view showing a plug and a socket of a connector according to an embodiment of the present invention.
Figure 2:
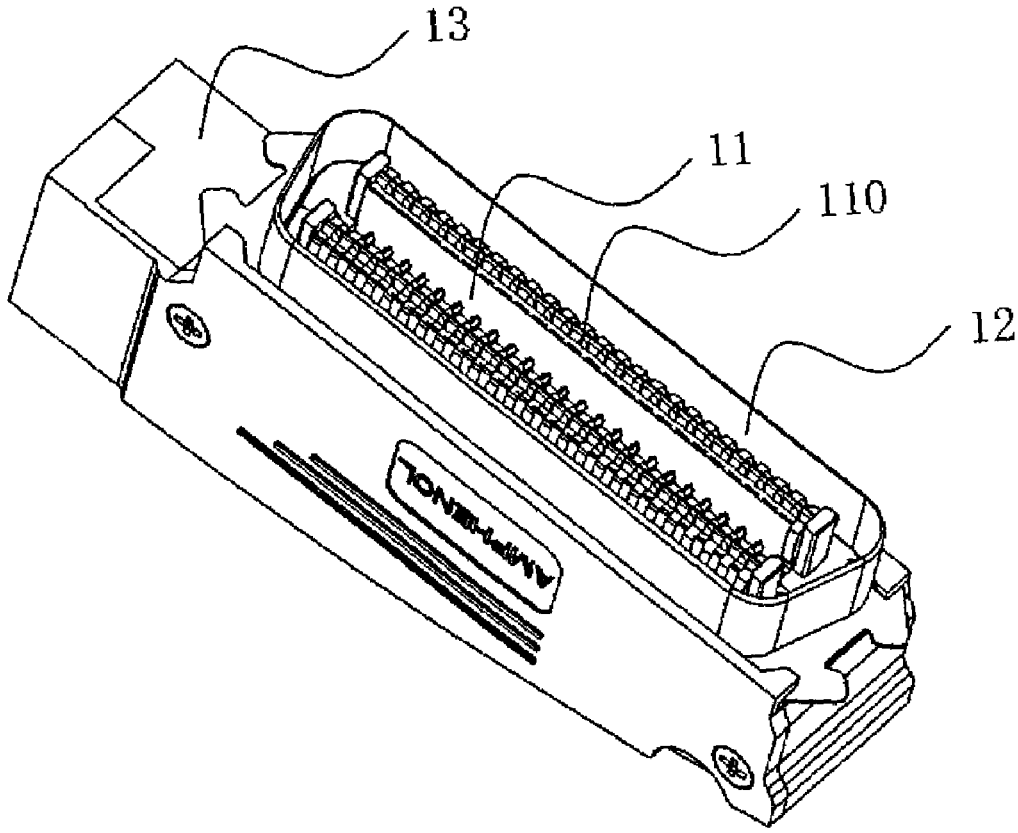
FIG. 2 is a perspective view showing the plug of FIG. 1.

As shown in FIG. 1, a connector according to an embodiment of the present invention contains a matching pair of plug 1 and socket 2. The plug 1, as illustrated in FIG. 2, contains a hollow casing 13 having a front opening and a side opening (both not numbered). The plug 1 further contains a plug assembly 11 housed inside the casing 13. The plug assembly 11 has two narrow blades 110 aligned in parallel and exposed from the front opening of the casing 13. An EMI shielding wall 12 is positioned at the front opening of the casing 13, surrounding the two blades 110. The side opening is for the access of a cable to the inside of the casing 13.

Figure 3:
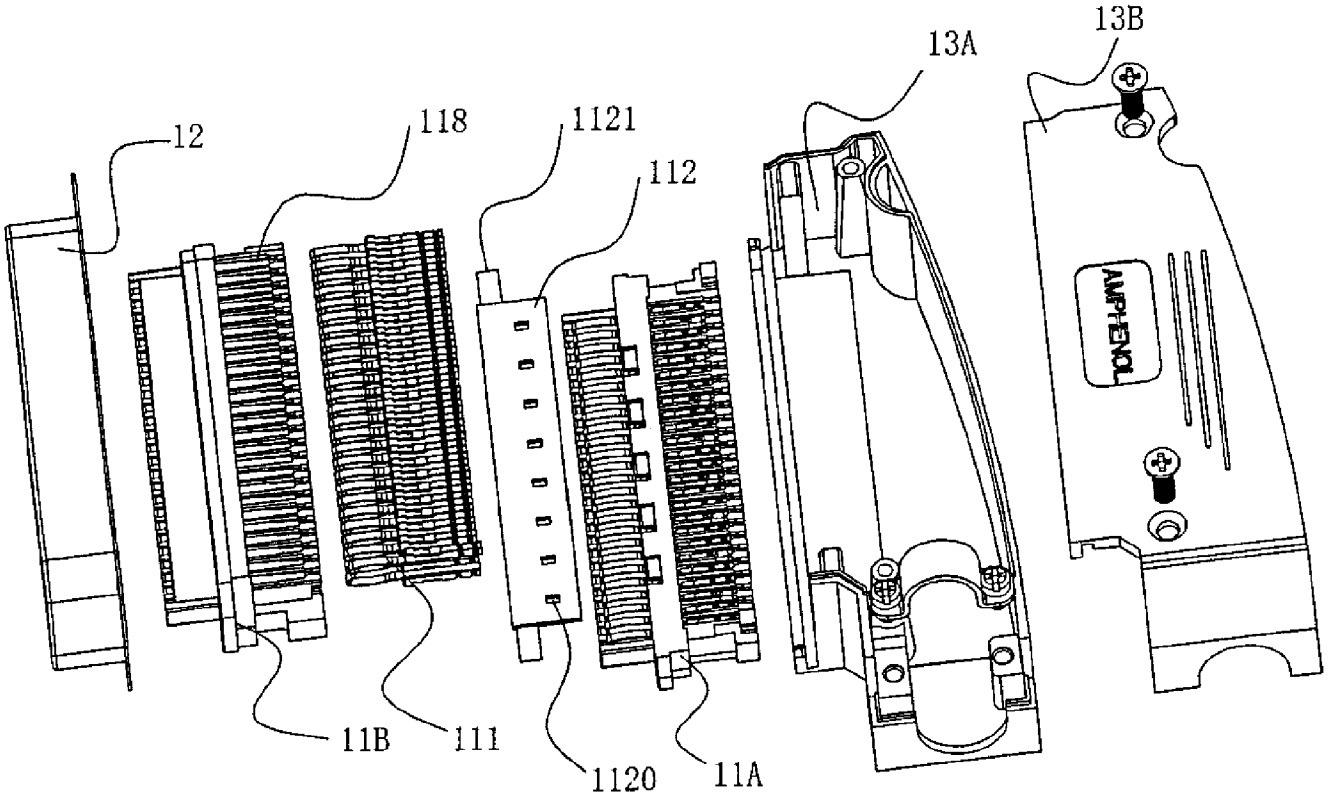
FIG. 3 is an exploded view showing the various components of the plug of FIG. 2.

As shown in FIG. 3, the casing 13 is formed by joining two casing pieces 13A and 13B side-by-side together. The casing pieces 13A and 13B are made of a metallic material.

Figure 4:
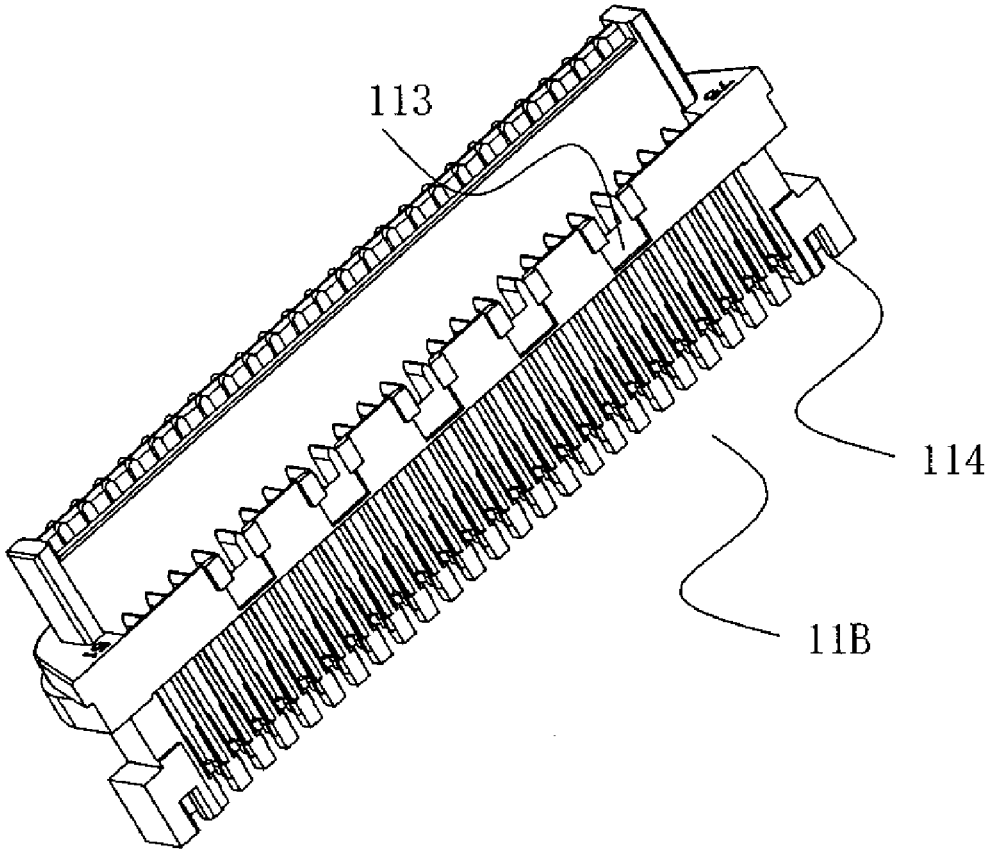
FIG. 4 is a perspective view showing one of the plug pieces of FIG. 3.
Figure 5:
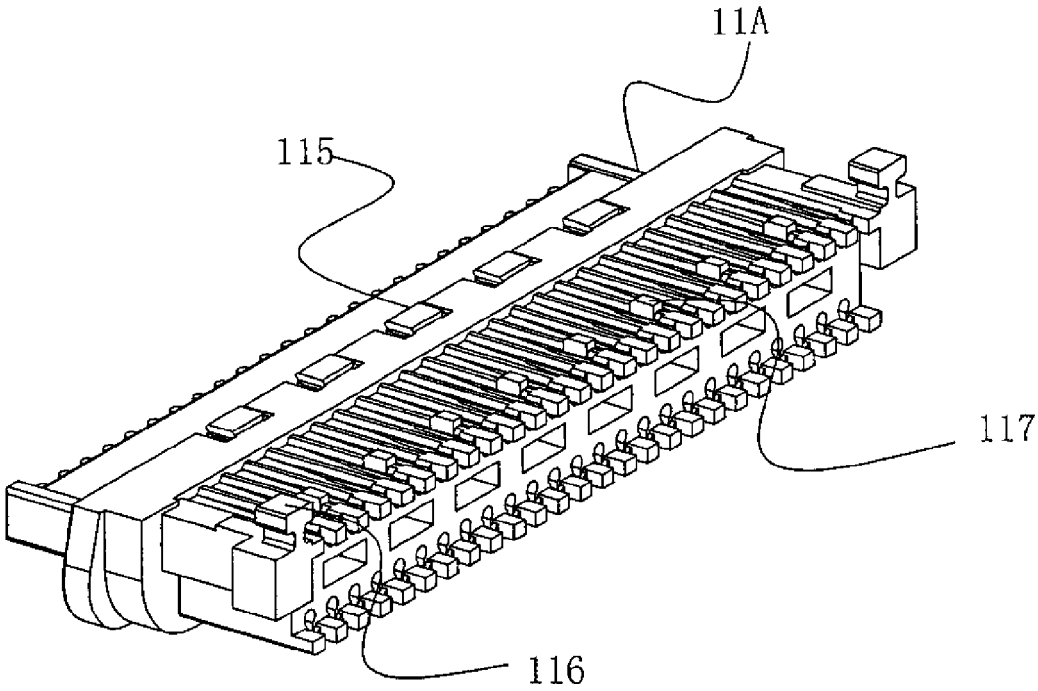
FIG. 5 is a perspective view showing the other plug pieces of FIG. 3.

The plug assembly 11 is also formed by laterally joining two plug pieces 11A and 11B together, each providing one of the blades 110 on a front side, respectively. As shown in FIGS. 4 and 5, one of the plug pieces (e.g., 11A) has a number of protruding bumps 115 and I-shaped ears 116 along a side interfacing with the other plug piece (e.g., 11B). On the other hand, the other plug piece has a number of corresponding and matching notches 113 and pockets 114 on its interfacing side for receiving the bumps 115 and the ears 116, respectively. The foregoing design allows the reliable assembly and convenient disassembly of the plug pieces 11A and 11B.

As illustrated in FIGS. 3 to 5, the plug pieces 11A and 11B have a large number of terminals 111 embedded and arranged regularly in parallel along two major sides of the plug pieces 11A and 11B, respectively. In the present embodiment, the plug pieces 11A and 11B have total 100 terminals 111, arranged in four parallel rows with 25 terminals in each row.

Figure 6:
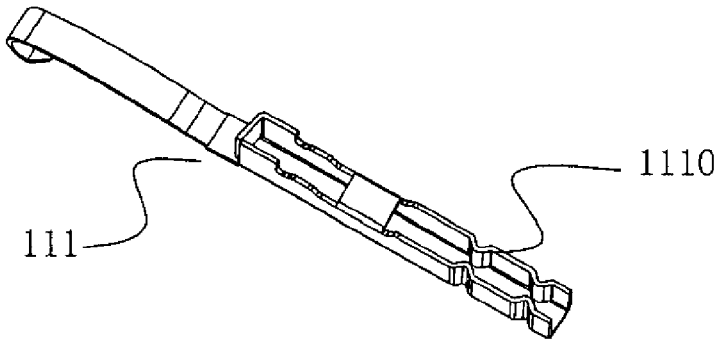
FIG. 6 is a perspective view showing one of the terminals of FIG. 3.

The terminals 111 has a middle section embedded in the plug piece 11A or 11B with a top tip and a bottom section exposed outside the plug piece 11A or 11B. A detailed view of the terminal 111 is shown in FIG. 6. As illustrated, the bottom section of the terminal 111 has a track 118 with a U-shaped cross section for the accommodation of a wire of the cable. The U-shaped track 118 has at least a pair of triangular indentations 1110 along the length of the track wall pointing towards each other with a distance smaller than the diameter of the wire so as to reliably clamp the wire without soldering.

As shown in FIG. 3, an insulating plate 112 is sandwiched between the bottom sections of the terminals 111 of the plug piece 111A and the bottom sections of the terminals 111 of the plug piece 11B. Along a side of the insulating plate 112, there are a number of notches 1120 arranged in a row. Correspondingly, one of the plug pieces (e.g., 11A shown in FIG. 5) has a number of bumps 117 arranged in a row among the terminals 111. When the plug pieces 11A and 11B are joined with the insulating plate 112 sandwiched between, the embedding of the bumps 117 in the notches 1120 holds the insulating plate 112 reliably at it position. As shown in FIG. 3, the insulating plate 112 has an embedded narrow conducting in plate 1121 extended laterally out of insulating plate 112 and the plug pieces 11A and 11B to directly contact the metallic casing 13. The EMI shielding wall 12 also has direct contact with the casing 13.

Figure 7:
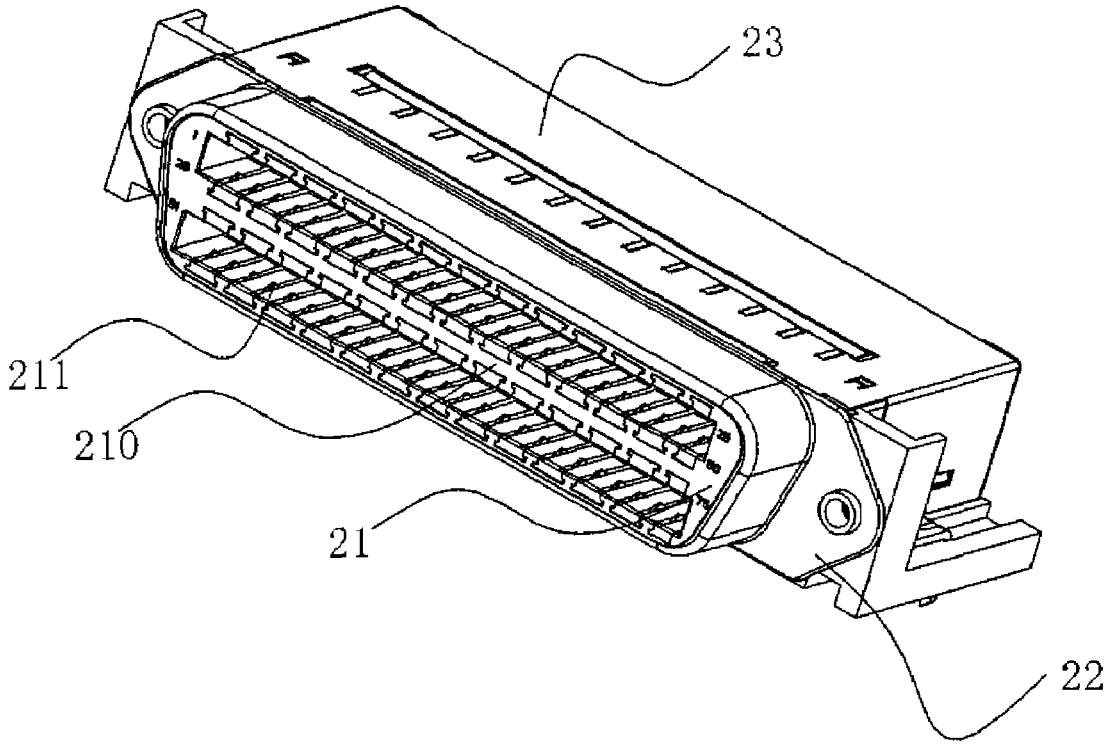
FIG. 7 is a perspective view showing the socket of FIG. 1.

The socket 2, as illustrated in FIG. 7, contains a hollow casing 23 having a front opening (not numbered). The socket 2 her contains a socket assembly 21 housed inside the casing 23. The socket assembly 21 has two narrow slots 210 aligned in parallel and exposed from the front opening of the casing 23. An EMI shielding wall 22 is positioned at the front opening of the casing 23, surrounding the two slots 210. The two slots 210 are for receiving the blades 110 of the plug 1, respectively, when the plug 1 is plugged into the socket 2.

Figure 8:
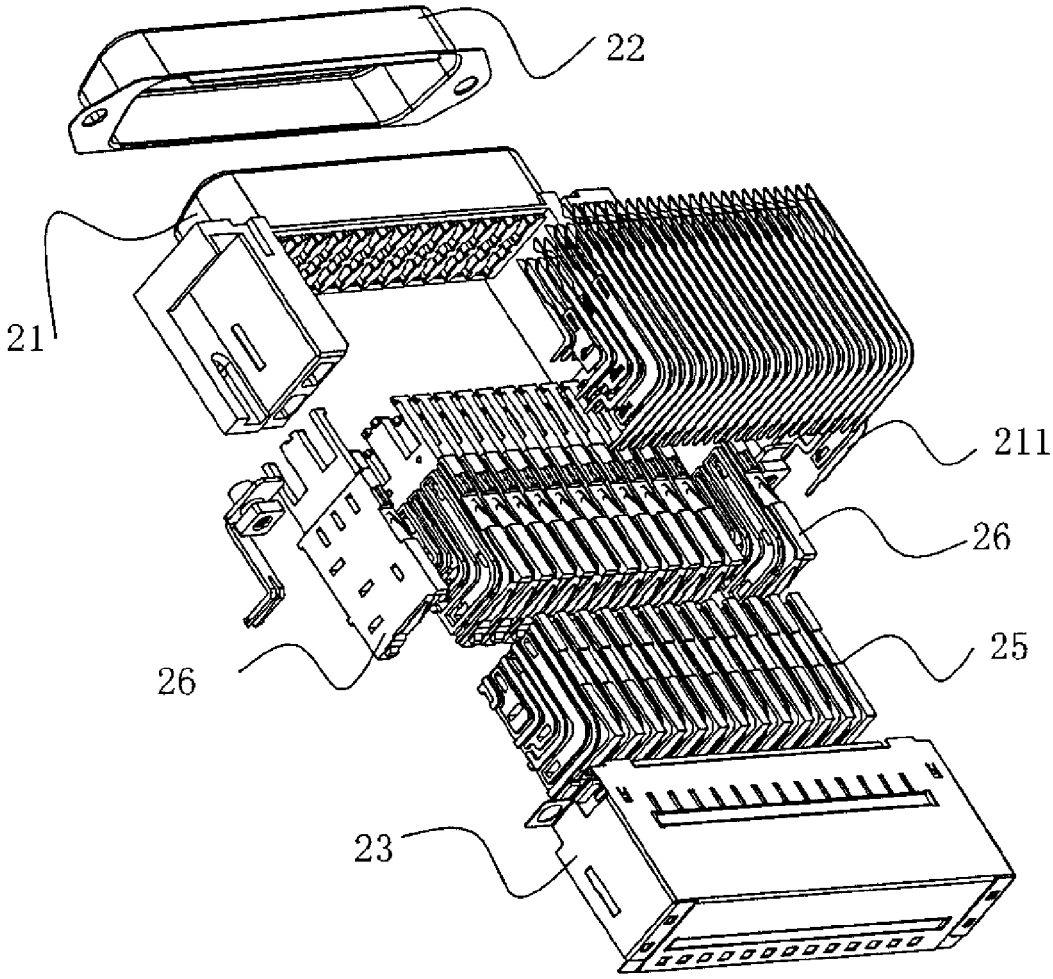
FIG. 8 is a perspective view showing the various components of the socket of FIG. 2.
Figure 9:
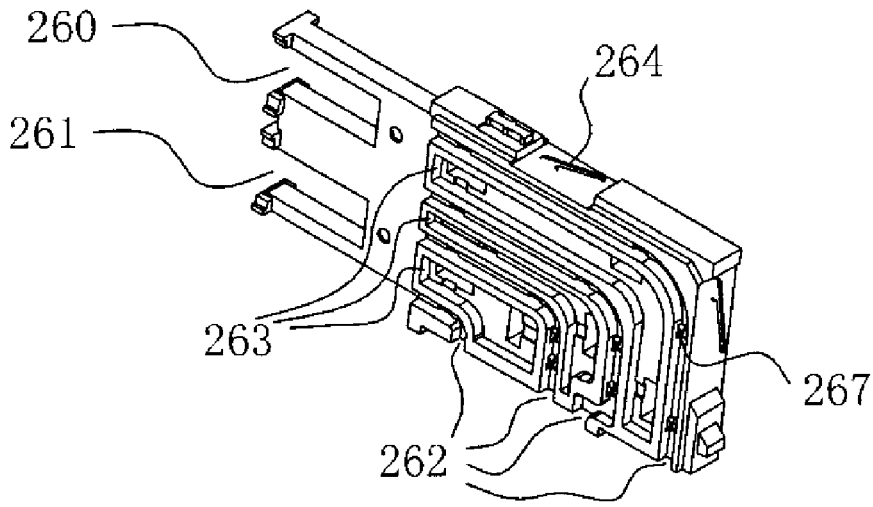
FIG. 9 is a perspective view showing one of the insulating pieces of FIG. 8.
Figure 10:
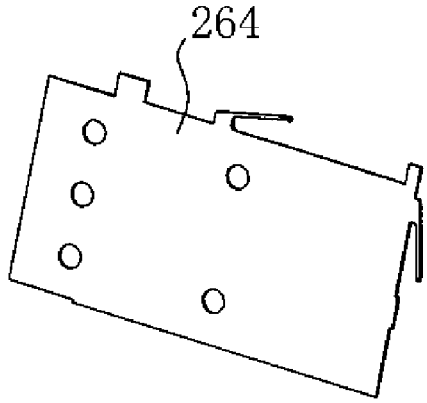
FIG. 10 is a perspective view showing one of the metallic plates inside the insulating pieces of FIG. 9.
Figure 11:
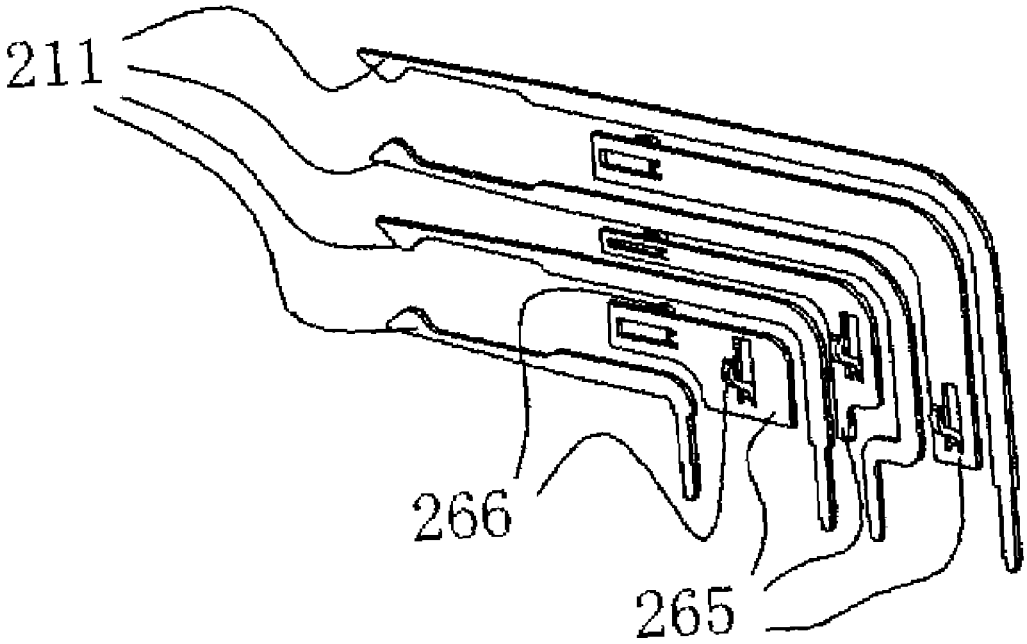
FIG. 11 is a perspective view showing the terminals and the shielding plates positioned in an insulating piece of FIG. 9.

As shown in FIG. 8, the socket assembly 21 contains a large number of L-shaped terminals 211 of four different dimensions. The socket assembly 21 further contains a number of flat shielding pieces 25 and flat insulating pieces 26 interleaved laterally so that their major sides interfacing with each other. As shown in FIG. 9, each insulating piece 26 has a three-prong front end forming two front troughs 260 and 261 matching the cross sections of the slots 210, respectively. As can be seen from FIG. 7, along two major sides of the slots 210, there are notches (not numbered) for receiving the front ends of the insulating pieces 26. As shown in FIG. 9, along a major side of each insulating piece 26, there are four L-shaped tracks 262 of four different dimensions for accommodating a middle section of four terminals 211, each of a different dimension, respectively. Inside each track 262, there are a number of bumps 267 for clamping a cable wire. Each terminal 211, after being housed inside a track 262, has a front end extended beyond the insulating piece 26 into a slot 210 and a back end exposed outside of the insulating piece 26 for an appropriate distance (so that they are exposed out of the socket assembly 21 and a bottom side of the casing 23). In this embodiment, the terminals 211 as such arranged are aligned in four rows, each having 25 terminals 211. As shown in FIGS. 9 and 10, a metallic plate 264 is housed inside each insulating piece 26 and extended outside from a top side or a back side of the insulating piece 26 to contact the casing 23. As shown in FIGS. 9 and 11, each insulating piece 26 has the areas between adjacent tracks 262 indented to form a number of L-shaped chambers 263, each for accommodating an L-shaped shielding plate 265. Again, to fit in these chambers 263, the shielding plates 265 are of different dimensions. As shown in FIG. 11, each shielding plate 265 has a number of hooks 266 protruding laterally through corresponding holes (not shown) of the insulating piece 26 to contact the metallic plate 264. In an alternative embodiment, the metallic plate 264 is housed inside the shielding piece 25 (made of an insulating material), rather than inside the insulating piece 26. In this alternative embodiment, the hooks 266 extend through corresponding holes (not shown) of the insulating piece 26 and an adjacent shielding piece 25 to contact the metallic plate 264 inside the shielding piece 25. The metallic plate 264 is extended out of a top or back side of the shielding piece to contact the casing 23. The casing 23 is made of a metallic material. The casing 23, on one hand, contacts the EMI shielding wall 22, which in turn contacts a grounding point configured on the socket 2. When the plug 1 is plugged into the socket 2, the EMI shielding wall 21 is sleeved into the EMI shielding wall 11 and, therefore, both the plug 1 and the socket 2 can achieve superior EMI shielding effect.

Figure 12:
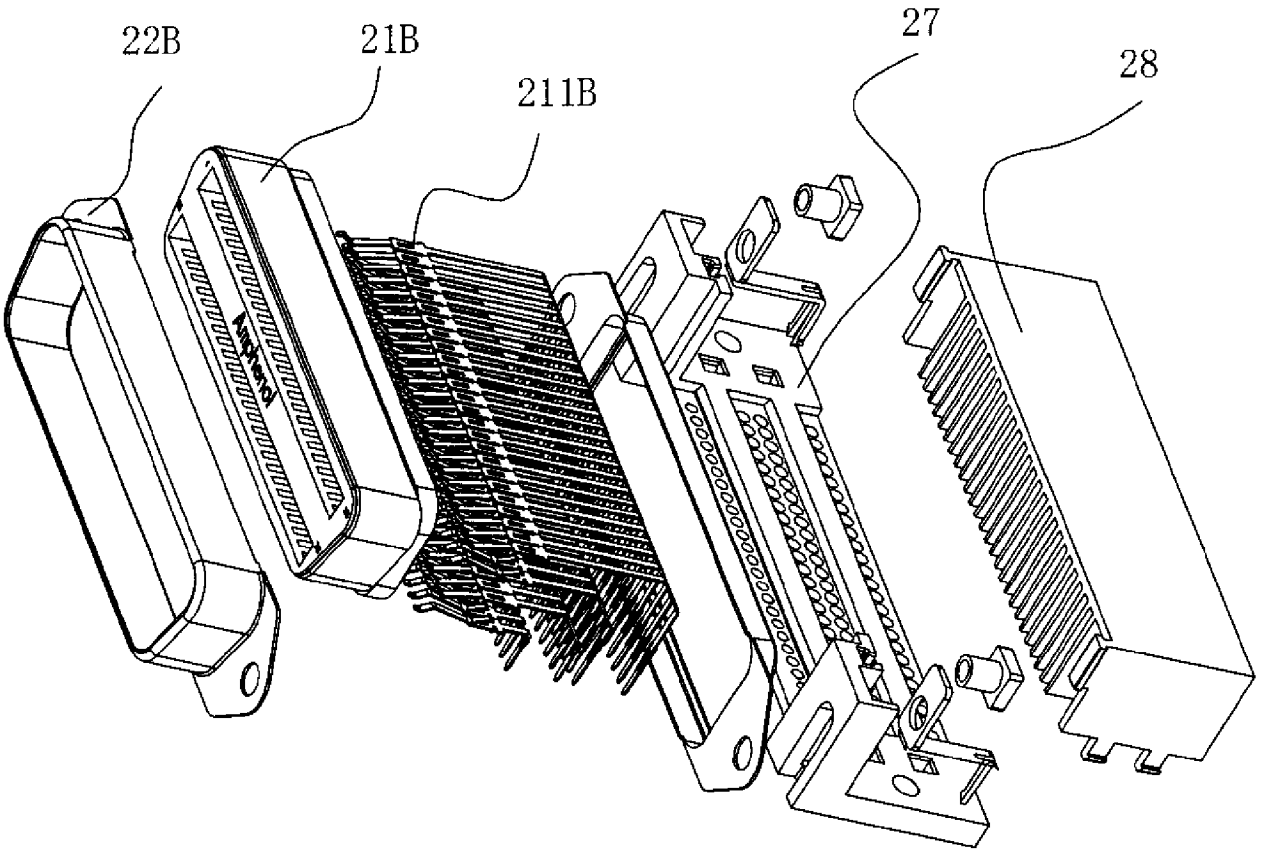
FIG. 12 is an exploded view showing the various components of a socket according to another embodiment of the present invention.

FIG. 12 shows another embodiment of the socket 2. As illustrated, the socket assembly 21B, the terminals 211B, and the EMI shielding wall 22B are very much similar to those of the previous embodiment. However, the casing 23 of the previous embodiment becomes a combination of a top cover 28 over a top side of a bottom board 27. The bottom board 27 is directly laid on a circuit board (not shown) and the bottom board 27 has a number of through holes for holding and allowing the back ends of the terminals 211B to penetrate through to reach the circuit board. The top cover 28 has a large number of parallel walls forming a large number of partitions to house the rows of terminals 211B, respectively. The metallic walls between the rows of terminals 211B provide EMI shielding.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A connector having a plug and a socket, said plug comprising:

a plug assembly having two plug pieces detachably and laterally joined together, each plug piece having a blade on a front side and a plurality of first terminals having a middle section embedded in said plug piece, each first terminal having a front tip and a bottom section exposed outside said plug piece, said front tips of said first terminals aligned along two major sides of said blades;

a hollow metallic first casing having a front opening and a side opening, said first casing housing said plug assembly so that said blades and said front tips of said first terminals are exposed from said front opening, said side opening allowing a cable of a plurality of wires to thread through;

a first shielding wall positioned on said front opening of said first casing enclosing said blades and said front tips of said first terminals, said first shielding wall contacting said first casing; and an insulating plate sandwiched between said plug pieces and between said bottom sections of said first terminals of said plug pieces, said insulating plate having an embedded conducting plate extended laterally out of said insulating plate to contact said first casing;

and said socket comprising:

a socket assembly having two slots on a front side corresponding and matching to said blades of said plug and a plurality of L-shaped second terminals of four different dimensions, said second terminals being laterally arranged in a plurality of rows, each row having four second terminals, each having a different dimension, front ends of said second terminals aligned along two major inner sides of said slots so that when said plug is plugged into said socket, each second terminal contacts a first terminal;

a hollow metallic second casing having a front opening, said second casing housing said socket assembly so that said slots and said front ends of said second terminals are exposed from said front opening, back ends of said second terminals extending outside said socket assembly and a bottom side of said second casing; and a second shielding wall positioned on said front opening of said second casing enclosing said slots and said front ends of said second terminals, said second shielding wall contacting said second casing, said second shielding wall contacting said first shielding wall when said plug is plugged into said socket.

2. The connector according to claim 1, wherein said bottom section of said first terminal has a track with a U-shaped cross section for accommodating a wire of said cable.

3. The connector according to claim 2, wherein said U-shaped track has at least a pair of triangular indentations along the length of said track pointing towards each other with a distance smaller than a diameter of said wires of said cable.

4. The connector according to claim 1, wherein said second casing comprises a top cover and a bottom board; said top cover joins to a top side of said bottom board; said bottom board has a plurality of through holes for holding and allowing said back ends of said second terminals to penetrate through; said top cover has a plurality of parallel walls forming a plurality of partitions to house said rows of said second terminals, respectively.

5. The connector according to claim 1, wherein said socket assembly further comprises a plurality of flat shielding pieces and flat insulating pieces interleaved laterally so that major sides of said shielding and insulating pieces interface with each other; each insulating piece has two troughs on a front side so that said two troughs of said insulating pieces jointly form said slots of said socket assembly, respectively; each insulating piece has four L-shaped tracks of four different dimensions for accommodating a middle section of four second terminals, each of a different dimension, respectively; and each insulating piece has at least a shielding plate positioned between two adjacent second terminals.

6. The connector according to claim 5, wherein a metallic plate is embedded in every insulating piece; each shielding plate of an insulating piece contacts said metallic plate of said insulating piece which in turn is extended out of said insulating piece to contact said second casing.

7. The connector according to claim 5, wherein a metallic plate is embedded in every shielding piece; each shielding plate of an insulating piece contacts said metallic plate of an adjacent shielding piece which in turn is extended out of said shielding piece to contact said second casing.

8. The connector according to claim 1, wherein a plug pieces has a plurality of protrusions along a side interfacing with the other plug piece; the other plug piece has a plurality of recesses corresponding and matching to said protrusions along a side interfacing with said plug piece; and each protrusion is detachably locked to a recess when said plug pieces are laterally joined together.

9. The connector according to claim 1, wherein a side of said insulating plate has a plurality of notches; one of said plug pieces has a plurality of corresponding and matching bumps facing said side of said insulating plate; and, when said plug pieces are joined with said insulating plate sandwiched between, said bumps are embedded in said notches to hold said insulating plate.

* * * * *